United States Patent [19]

Eiffler et al.

[11] Patent Number: 4,978,487

[45] Date of Patent: Dec. 18, 1990

[54] METHOD OF TREATING A COATING ON A REACTOR COOLANT PUMP SEALING SURFACE

[75] Inventors: Elmer E. Eiffler, Glenshaw; Natraj C. Iyer, Monroeville; Alan T. Male, Murrysville; David J. Boes, Monroeville, all of Pa.

[73] Assignee: Westinghouse Electric Corp., Pittsburgh, Pa.

[21] Appl. No.: 296,654

[22] Filed: Jan. 13, 1989

[51] Int. Cl.[5] ..... B05D 3/12

[52] U.S. Cl. ..... 264/60; 264/102; 264/325; 427/370

[58] Field of Search ..... 264/60, 101, 102, 267, 264/313, 325; 427/370; 419/49

[56] References Cited

U.S. PATENT DOCUMENTS 4,142,888 3/1979 Rozmus ..... 419/49 GR
4,871,297 10/1989 Boes et al. ..... 415/170.1 OR

FOREIGN PATENT DOCUMENTS 7804454 4/1978 Netherlands ..... 427/370

*Primary Examiner*—Jan H. Silbaugh
*Assistant Examiner*—Christopher A. Fiorilla

[57] ABSTRACT

An annular chromium carbide coating on an annular sealing surface of a stainless steel sealing assembly component for use in a nuclear reactor coolant pump, is treated by encasing at least the chromium carbide coating on the stainless steel sealing surface by applying a metallic cover thereover, evacuating the atmosphere between the cover and the coating on the sealing surface, hot isostatic pressing the stainless steel sealing assembly component and the chromium carbide coating thereon encased by the cover, cooling the sealing assembly component and the coating thereon encased by the cover, and after cooling thereof removing the cover from the coating. The result is a chromium carbide coating on the sealing component substrate densified substantially to its full theoretical density (greater than 99%) and metallurgically bonded by the hot isostatic pressing to the substrate exterior surface.

10 Claims, 6 Drawing Sheets

METHOD OF TREATING A COATING ON A REACTOR COOLANT PUMP SEALING SURFACE

CROSS REFERENCE TO RELATED APPLICATIONS

Reference is hereby made to the following copending applications and issued patents dealing with related subject matter and assigned to the assignee of the present invention:

1. "Sealing Devices For The Drive Shaft Of A High Pressure Fluid Pump" by N. Bonhomme, assigned U.S. Ser. No. 379,196 and filed May 17, 1982, now U.S. Pat. No. 4,587,076, issued May 6, 1986.
2. "Reactor Coolant Pump Hydrostatic Sealing Assembly With Improved Hydraulic Balance" by R. F. Guardiani et al, assigned U.S. Ser. No. 063,331 and filed June 17, 1987, now U.S. Pat. No. 4,838,559, issued June 13, 1989.
3. "Reactor Coolant Pump Sealing Surface With Titanium Nitride Coating" by G. Zottola et al, assigned U.S. Ser. No. 035,832 and filed Apr. 8, 1987, now U.S. Pat. No. 4,871,297, issued Oct. 3, 1989.
4. "Reactor Coolant Pump Hydrostatic Sealing Assembly With Externally Pressurized Hydraulic Balance Chamber" by C. P. Nyilas et al, assigned U.S. Ser. No. 091,224 and filed Aug. 31, 1987, now U.S. Pat. No. 4,848,774, issued July 18, 1989.
5. "Reactor Coolant Pump Shaft Seal Utilizing Shape Memory Metal" by D. J. Janocko, assigned U.S. Ser. No. 197,174 and filed May 23, 1988.
6. "Reactor Coolant Pump Auxiliary Seal For Reactor Coolant System Vacuum Degasification" by J. D. Fornoff, assigned U.S. Ser. No. 222,649 and filed July 21, 1988, now U.S. Pat. No. 4,847,041, Issued July 11, 1989.
7. "Reactor Coolant Pump Having Double Dam Seal With Self-Contained Injection Pump Mechanism" by D. J. Janocko, assigned U.S. Ser. No. 231,039 and filed Aug. 12, 1988.

BACKGROUND OF THE INVENTION

1. Field of the Invention

The present invention relates generally to shaft seals and, more particularly, is concerned with a method of treating a coating on seal surface in a nuclear reactor coolant pump.

2. Description of the Prior Art

In pressurized water nuclear power plants, a reactor coolant system is used to transport heat from the reactor core to steam generators for the production of steam. The steam is then used to drive a turbine generator. The reactor coolant system includes a plurality of separate cooling loops, each connected to the reactor core and containing a steam generator and a reactor coolant pump.

The reactor coolant pump typically is a vertical, single stage, centrifugal pump designed to move large volumes of reactor coolant at high temperatures and pressures, for example 550 degrees F. and 2500 psi. The pump basically includes three general sections from bottom to top—hydraulic, shaft seal and motor sections. The lower hydraulic section includes an impeller mounted on the lower end of a pump shaft which is operable within the pump casing to pump reactor coolant about the respective loop. The upper motor section includes a motor which is coupled to drive the pump shaft. The middle shaft seal section includes three tandem sealing assemblies—lower primary, middle secondary and upper tertiary sealing assemblies. The sealing assemblies are located concentric to, and near the top end of, the pump shaft. Their combined purpose is to mechanically contain the high positive pressure coolant of the reactor coolant system from leakage along the pump shaft to the containment atmosphere during normal operating condition. Representative examples of pump shaft sealing assemblies known in the prior art are the ones disclosed in U.S. Patents to MacCrum (3,522,948), Singleton (3,529,838), Villasor (3,632,117), Andrews et al (3,720,222), Boes (4,275,891), Jenkins (4,690,612) and Quinn (4,693,481) and in the first three patent applications cross-referenced above, all of which are assigned to the same assignee as the present invention.

Historically, the pump shaft seals constitute the main problem area for the reactor coolant pumps and significantly contribute to the utilization factor in nuclear power plants. The seals must be capable of breaking down the high system pressure (about 2500 psi) safely. The tandem arrangement of the three seals is used to break down the pressure, with the lower primary seal absorbing most of the pressure drop (approximately 2250 psi). The lower primary sealing assembly is the main seal of the pump. It is typically a hydrostatic, "film-riding" , controlled leakage seal whose primary components are an annular runner which rotates with the pump shaft and a non-rotating seal ring which remains stationary with the pump housing Whereas the components of the lower primary sealing assembly are not intended to contact or rub together, corresponding components of the middle and upper sealing assemblies, a rotating runner and non-rotating seal ring, provide contacting or rubbing seals.

Heretofore, the runner components of the rub-type sealing assemblies (the middle secondary and upper tertiary sealing assemblies) have been composed of a stainless steel substrate having an outer coating of chromium carbide on the surface of the runner components which rubs against the seal ring. The coating is formed by depositing chromium carbide powder on the stainless steel substrate using a detonation gun technique. Bonding between the coating and the substrate is achieved purely by mechanical impact forces when the powdered chromium carbide is impinged onto the substrate. The density of the coating thus applied is typically significantly less than 100% of theoretical.

The chromium carbide coating thus formed has proven to be less than satisfactory. Blistering has been observed to occur on the chromium carbide coated runners. The blistering is caused by contact with the nuclear water chemistry employed in nuclear reactors. This liquid penetrates through the pores of the chromium carbide coating to the stainless steel/coating interface creating a electrochemical cell and resultant corrosion. Hydrogen gas formation caused by the corrosive mechanism then results eventually in a spalling, or blistering, of the coating's surface. Thus, the blistering is attributed to the inherent porosity heretofore present in the coating and the lack of optimum bonding at the stainless steel/coating interface.

Consequently, a need exists for an effective way to prevent corrosion of the rubbing surfaces of the reactor coolant pump sealing assembly so as to improved the reliability thereof.

SUMMARY OF THE INVENTION

The present invention provides a method of treating a coating employed on a sealing surface of a sealing assembly component so as to satisfy the aforementioned needs. The corrosion/erosion resistant characteristics of the seal is enhanced through increased densification and improved bonding of the coating.

U.S. Pat. No. 4,317,850 to Verburgh et al discloses applying a gas-tight metal foil over a coating on a metal object, such as a cylindrical pipe, followed by isostatically compressing the coated pipe to provide a high density coating thereon with improved adhesion to the underlying metal. However, there is no mention in this patent that the region underlying the metal foil is evacuated before isostatically compressing the coating. Thus, the method of this patent does not appear to be directly applicable to the coating treatment as envisioned by the present invention.

Accordingly, the present invention is directed to a method of treating an annular coating, such as composed of chromium carbide, on an annular sealing surface of a sealing assembly component, such as composed of stainless steel, for use in a nuclear reactor coolant pump. The treating method comprises the steps of: (a) applying chromium carbide on the annular sealing surface of the sealing assembly component to form an annular chromium carbide coating thereon; (b) encasing at least the chromium carbide coating on the stainless steel sealing surface by applying a metallic cover thereover; (c) evacuating the atmosphere between the cover and the coating on the sealing surface; (d) hot isostatic pressing the stainless steel sealing assembly component and the chromium carbide coating thereon encased by the cover in order to densify the coating to substantially its full theoretical density (greater than 99%) and metallurgically bond the coating to the surface of the sealing assembly component. More particularly, the encasing is carried out by welding the cover to the surface of the sealing assembly component so as to seal the coating thereon from the external atmosphere.

Alternatively, the encasing is carried out by enclosing the sealing assembly component and coating thereon in a sealed metallic container. Also, a barrier, such as a ceramic insert, may be placed between the interior of the container and the surface of component with the coating applied thereon. Further, a molybdenum sheet may be placed between the barrier and the surface of the component with the coating applied thereon.

The hot isostatic pressing is carried out at a temperature within the range of 1000 to 1300 degrees C. and at a pressure within the range of 10,000 to 30,000 psi. The treating method further comprises cooling the sealing assembly component and the coating thereon encased by the cover, and, after the cooling thereof, removing the cover from the coating. The cooling is carried out at a rate of about 100 degrees C. per hour.

The present invention is also directed to a rubbing-type sealing assembly for use in a reactor coolant pump to sealably and rotatably mount a shaft relative to a housing in the pump. The sealing assembly includes an annular runner comprising: (a) an annular substrate composed of stainless steel and having an exterior rubbing sealing surface with an annular groove formed thereon; and (b) a coating of chromium carbide filling the annular groove on the substrate exterior surface and projecting therefrom, the coating being densified to substantially full theoretical density and metallurgically bonded by a hot isostatic pressing process to the substrate exterior surface.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
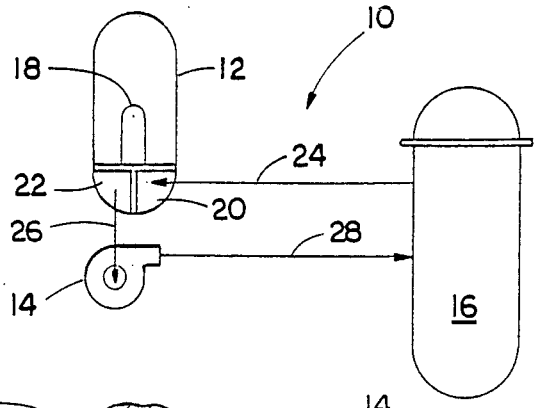
FIG. 1 (PRIOR ART)
FIG. 1 is a schematic representation of one cooling loop of a conventional nuclear reactor coolant system which includes a steam generator and a reactor coolant pump connected in series in a closed coolant flow circuit with the reactor core.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Prior Art Reactor Coolant Pump

Referring now to the drawings, and particularly to FIG. 1, there is shown a schematic representation of one of a plurality of cooling loops 10 of a conventional nuclear reactor coolant system. The cooling loop 10 includes a steam generator 12 and a reactor coolant pump 14 serially connected in a closed coolant flow circuit with a nuclear reactor core 16. The steam generator 12 includes primary tubes 18 communicating with inlet and outlet plenums 20, 22 of the generator. The inlet plenum 20 of the steam generator 12 is connected in flow communication with the outlet of the reactor core 16 for receiving hot coolant therefrom along flow path 24 of the closed flow circuit. The outlet plenum 22 of the steam generator 12 is connected in flow communication with an inlet suction side of the reactor coolant pump 14 along flow path 26 of the closed flow circuit. The outlet pressure side of the reactor coolant pump 14 is connected in flow communication with the inlet of the reactor core 16 for feeding cold coolant thereto along flow path 28 of the closed flow circuit.

In brief, the coolant pump 14 pumps the coolant under high pressure about the closed flow circuit. Particularly, hot coolant emanating from the reactor core 16 is conducted to the inlet plenum 20 of the steam generator 12 and to the primary tubes 18 in communication therewith. While in the primary tubes 18, the hot coolant flows in heat exchange relationship with cool feedwater supplied to the steam generator 12 via conventional means (not shown). The feedwater is heated and portions thereof changed to steam for use in driving a turbine generator (not shown). The coolant, whose temperature has been reduced by the heat exchange, is then recirculated to the reactor core 16 via the coolant pump 14.

The reactor coolant pump 14 must be capable of moving large volumes of reactor coolant at high temperatures and pressures about the closed flow circuit. Although, the temperature of the coolant flowing from the steam generator 12 to the pump 14 after heat exchange has been cooled substantially below the temperature of the coolant flowing to the steam generator 12 from the reactor core 16 before heat exchange, its temperature is still relatively high, being typically about 550 degrees F. The coolant pressure produced by the pump is typically about 2500 psi.

Figure 2:
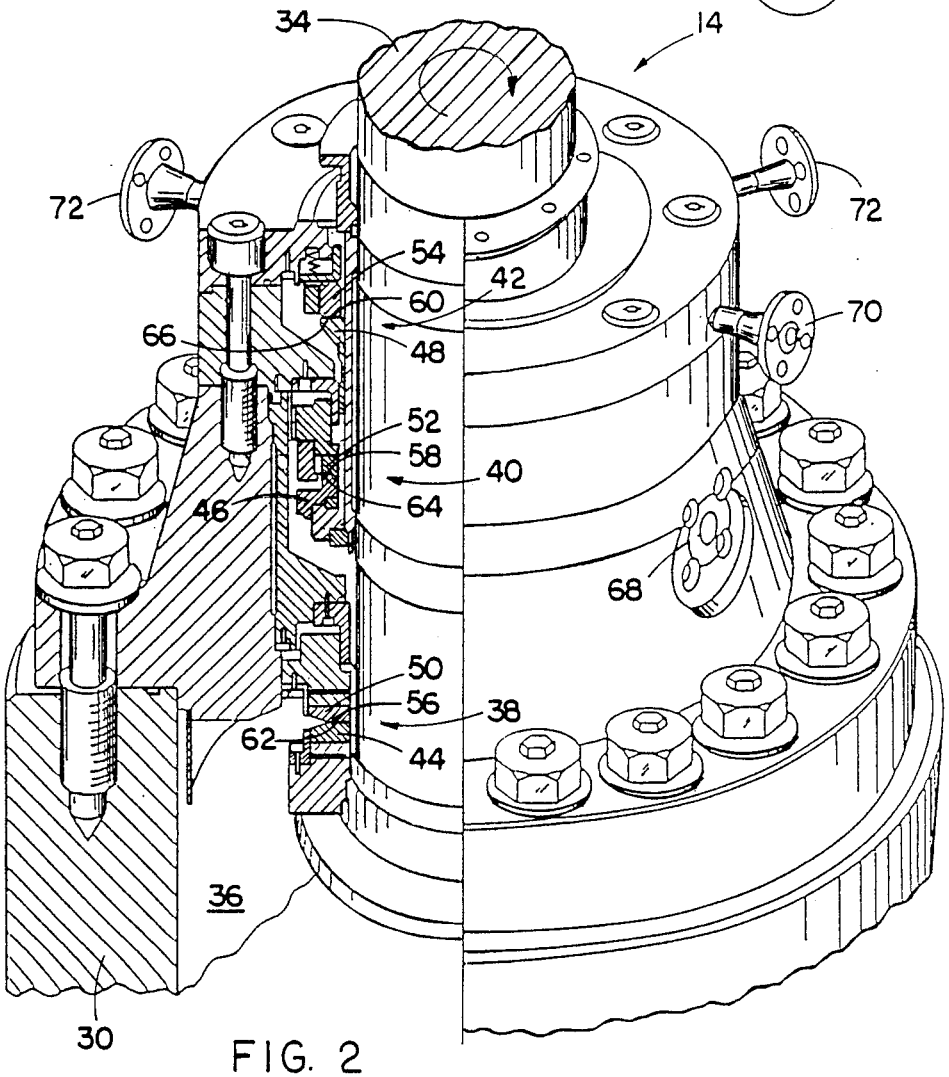
FIG. 2 (PRIOR ART)
FIG. 2 is a cutaway perspective view of the shaft seal section of a conventional reactor coolant pump, illustrating in cross-section the seal housing and the lower primary, middle secondary and upper tertiary sealing assemblies which are disposed within the seal housing and surround the pump shaft in this section of the pump.
Figure 3:
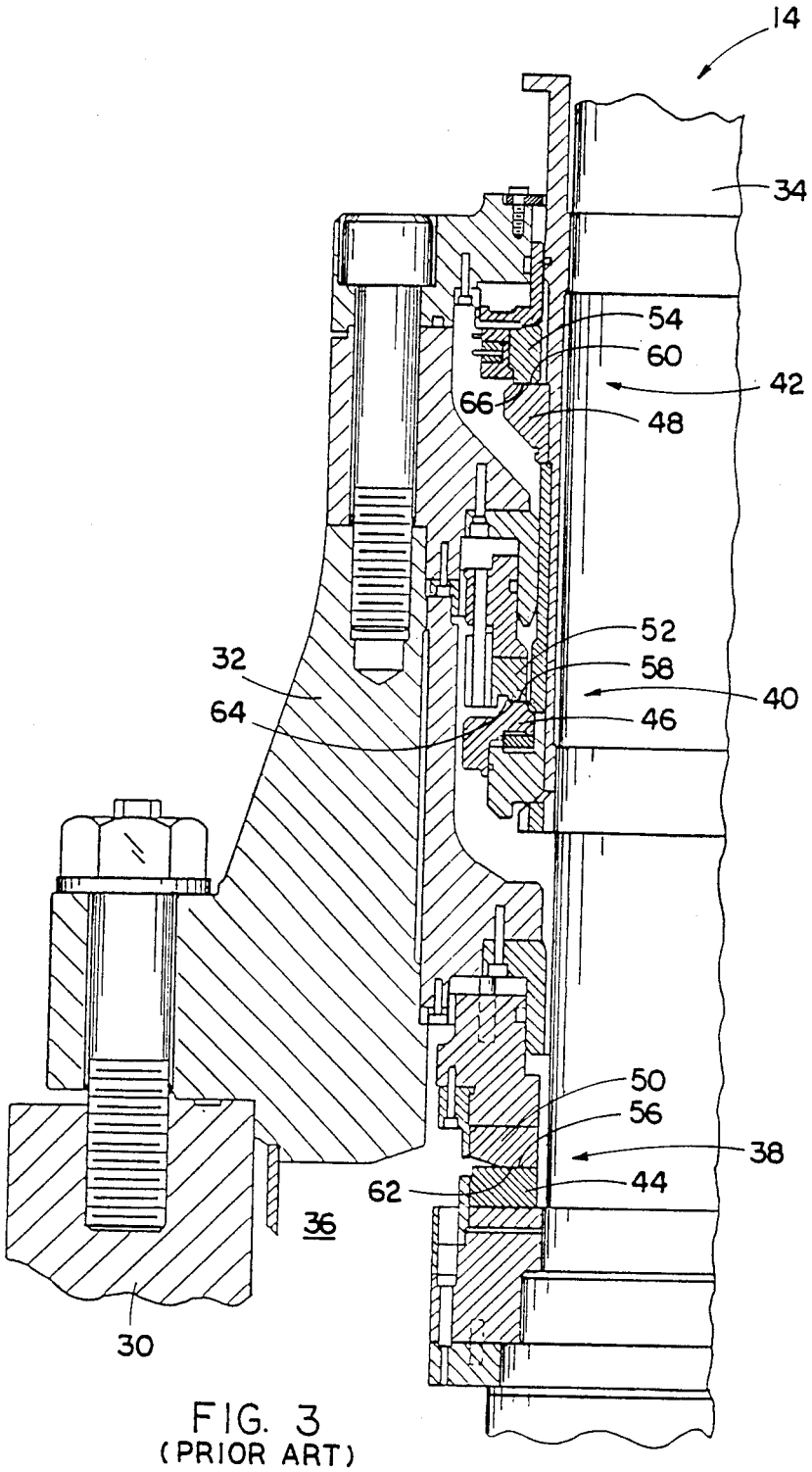
FIG. 3 (PRIOR ART)
FIG. 3 is an enlarged axial sectional view of the seal housing and sealing assemblies of the reactor coolant pump of FIG. 2.

As seen in FIGS. 2 and 3, the prior art reactor coolant pump 14 generally includes a pump housing 30 which terminates at one end in a seal housing 32. The pump 14 also includes a pump shaft 34 extending centrally of the housing 30 and being sealingly and rotatably mounted within the seal housing 32. Although not shown, the bottom portion of the pump shaft 34 is connected to an impeller, while a top portion thereof is connected to a high-horsepower, induction-type electric motor. When the motor rotates the shaft 34, the impeller within the interior 36 of the housing 30 circulates the coolant flowing through the pump housing 30 at pressures from ambient to approximately 2500 psi cover gas. This pressurized coolant applies an upwardly directed, hydrostatic load upon the shaft 34 since the outer portion of the seal housing 32 is surrounded by the ambient atmosphere.

In order that the pump shaft 34 might rotate freely within the seal housing 32 while maintaining the 2500 psi pressure boundary between the housing interior 36 and the outside of the seal housing 32, tandemly-arranged lower primary, middle secondary and upper tertiary sealing assemblies 38, 40, 42 are provided in the positions illustrated in FIGS. 2 and 3 about the pump shaft 34 and within the pump housing 30. The lower primary sealing assembly 38 which performs most of the pressure sealing (approximately 2250 psi) is of the non-contacting hydrostatic type, whereas the middle secondary and upper tertiary sealing assemblies 40, 42 are of the contacting or rubbing mechanical type.

Each of the sealing assemblies 38, 40, 42 of the pump 14 generally includes a respective annular runner 44, 46, 48 which is mounted to the pump shaft 34 for rotation therewith and a respective annular seal ring 50, 52, 54 which is stationarily mounted within the seal housing 32. The respective runners 44, 46, 48 and seal rings 50, 52, 54 have top and bottom end surfaces 56, 58, 60 and 62, 64, 66 which face one another. The facing surfaces 56, 62 of the runner 44 and seal ring 50 of the lower primary sealing assembly 38 normally do not contact one another but instead a film of fluid normally flows between them. On the other hand, the facing surfaces 58, 64 and 60, 66 of the runners and seal rings 46, 52 and 48, 54 of the middle secondary and upper tertiary sealing assemblies 40 and 42 normally contact or rub against one another.

Because the primary sealing assembly 38 normally operates in a film-riding mode, some provision must be made for handling coolant fluid which "leaks off" in the annular space between the seal housing 32 and the shaft 34 rotatably mounted thereto. Accordingly, the seal housing 32 includes a primary leakoff port 68, whereas secondary and tertiary leakoff ports 70, 72 accommodate coolant fluid leakoff from secondary and tertiary sealing assemblies 40, 42.

Figure 5:
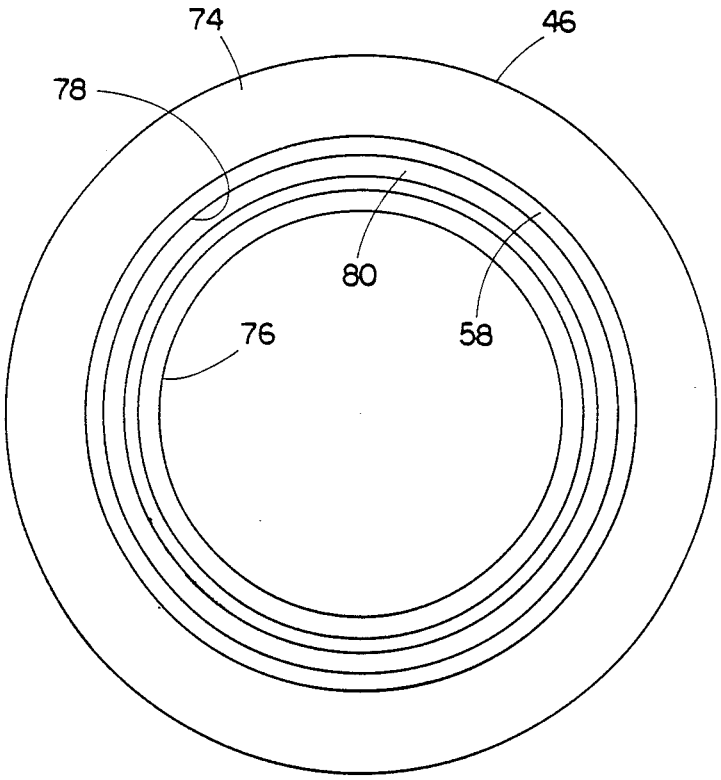
FIG. 5 is a top plan view of the runner as seen along line 5—5 of FIG. 4.
Figure 4:
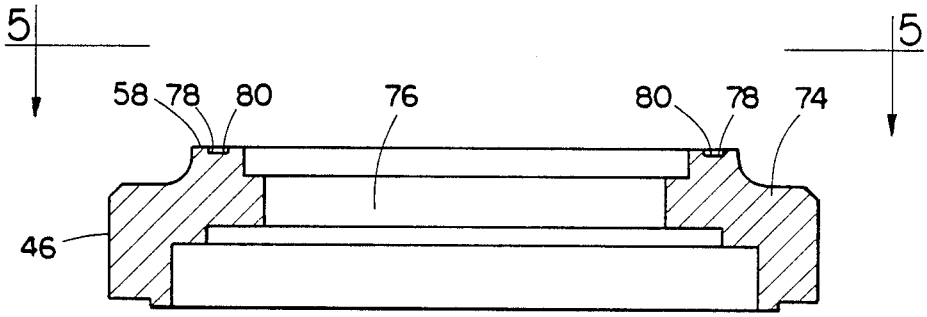
FIG. 4 is an enlarged axial sectional view of the runner of the middle sealing assembly of the reactor coolant pump of FIG. 3, illustrating a chromium carbide coating deposited on the top end surface of the runner.

Turning now to FIGS. 4 and 5, there is shown the annular runner 46 of the rubbing-type secondary sealing assembly 40. The runner 46 is in the form an annular substrate 74 composed of stainless steel, such as 304, 16 or 410 types, having a central opening 76. Also, the exterior top rubbing sealing surface 58 on the substrate 4 has an annular groove 78 formed thereon. By way of example, the groove 78 is about 0.007 inch deep and ½ inch wide. A coating 80 of chromium carbide, having a thickness within the range of about 0.006 inch to 0.008 inch, is applied, such as with a conventional detonation gun (not shown), to fill the annular groove 78 on the exterior surface 58 and face outwardly therefrom.

The impact force in application of the coating 80 by use of the detonation gun, at best, provides only a mechanical bonding of the coating 80 to the substrate surface 58 at their interface, as compared to a more desirable metallurgical bonding, such as by diffusion, of the two materials together at their interface. Furthermore, the density of the coating 80 thus applied is significantly less than 100% of theoretical. For that matter, it is less than 96% of theoretical, leaving interconnecting pores in the coating which allow undesirable penetration thereof by the reactor coolant fluid to the coating/substrate interface. This inherent porosity in the coating and the lack of optimum bonding at the interface results in blistering of the coating.

The same coating is applied to a groove on the runner 48 of the rubbing-type tertiary sealing assembly 42. Thus, the treatment method of the present invention is applicable to both of the runners 46, 48.

Seal Coating Treatment Method for Enhanced Corrosion Resistance

Figure 6:
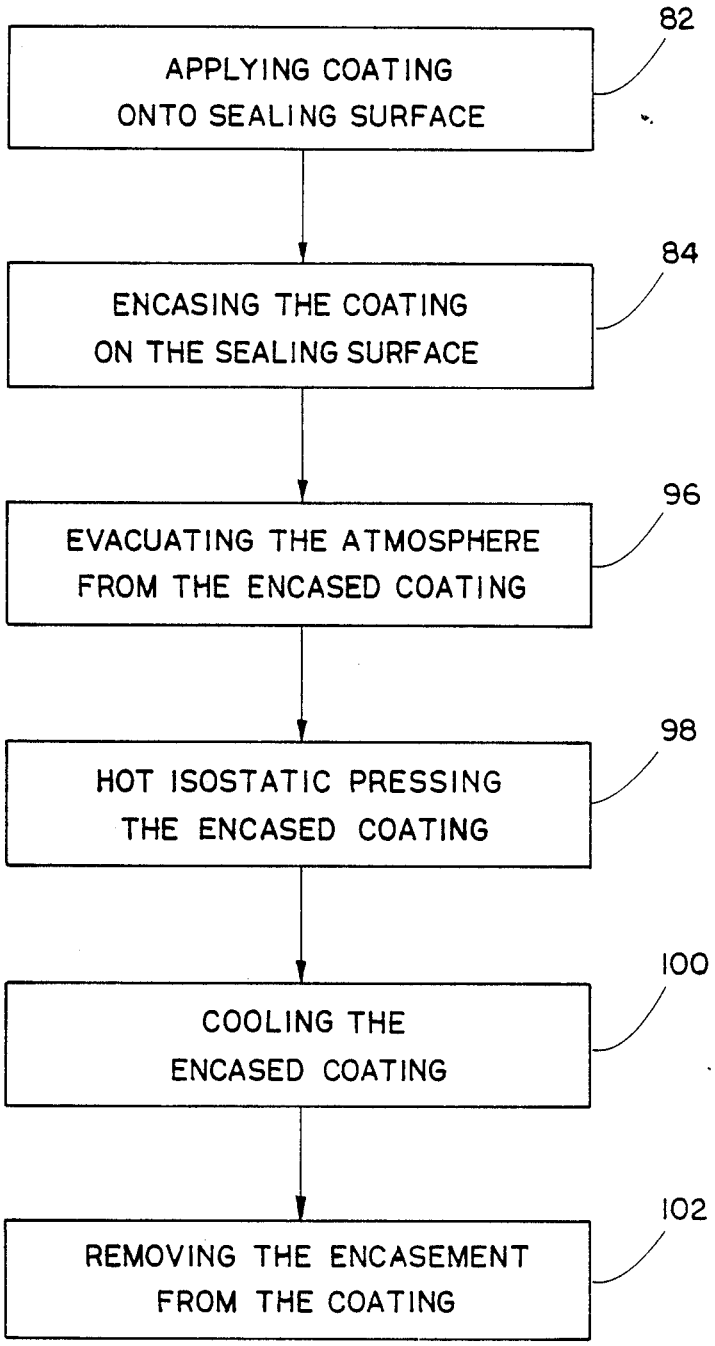
FIG. 6 is a flow chart illustrating the steps in the coating treatment method of the present invention.

For enhancement of the corrosion/erosion resistant characteristics of the coating 80 so as to eliminate blistering thereof, the treatment method of the present invention as depicted in the flow chart in FIG. 6 is used. Block 82 depicts the initial step in the treatment method of applying the chromium carbine material in powder form by the detonation gun onto the groove 78 of the runner substrate surface 58 to form the coating 80 thereon. Either a mechanical bond can be formed in this step or alternatively the coating is applied primarily in the form of a layer of powder with the actual bonding occurring later.

Figure 7:
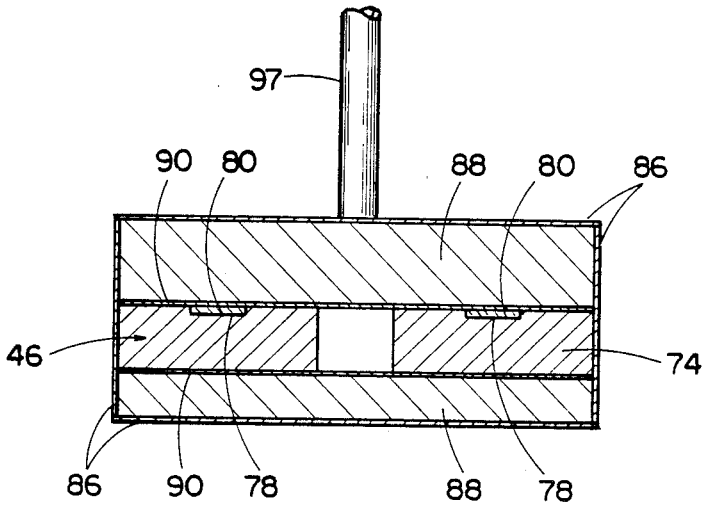
FIG. 7 is a schematical axial sectional view of one set of components for carrying out the coating treatment method of the present invention wherein the entire coating and substrate are encased.
Figure 8:
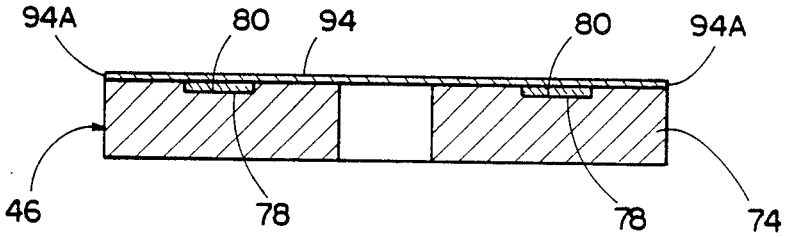
FIG. 8 is a schematical axial sectional view of another set of components for carrying out the coating treatment method of the present invention wherein only the coating on the substrate is encased.

Block 84 in FIG. 6 shows the second step in the treatment method of encasing the coating 80 on the sealing surface 58. One of two alternatives can be used for encasing the coating. In FIG. 7, both the substrate 74 and coating 80 are encased by enclosing or containerizing the runner substrate 74 and coating 80 thereon in a sealed container 86, composed of a suitable material such as stainless steel or molybdenum. Also, preferably, a barrier, such as a ceramic insert, together with a molybdenum sheet 90 is placed between the interior of the container 86 and each of the top and bottom surfaces 58, 92 of the runner 46 to ensure separation of the runner from the container 86. On the other hand, in FIG. 8, only the coating 80 is encased and sealed from the external atmosphere by a cover 94, composed of a suitable material such as stainless steel or molybdenum, welded such as by an electron beam at its opposite edges 94A to the substrate 74.

Block 96 in FIG. 6 depicts the third step in the treatment method of evacuating the atmosphere via a pipe 97 seen in FIG. 7 from between the container 86 or cover 94 and coating 80 on the runner substrate sealing surface 58. Block 98 depicts the fourth step in the treatment method of hot isostatic pressing the runner substrate 74 and coating 80 thereon encased by the container 86 or cover 94 in order to densify the coating 80 to substantially its full theoretical density (greater than 99%) and metallurgically bond the coating 80 to the surface 58 of the runner substrate 74 in the groove 78 thereon. More particularly, the runner substrate 74 with the coating 80 thereon are placed in a conventional hot isostatic press (not shown) and subjected to a high pressure-temperature cycle. The material of the container 86 or cover 94 are capable of withstanding the high pressure-temperature cycle. Preferably, the hot isostatic pressing is carried out at a temperature within the range of 1000 to 1300 degrees C. and at a pressure within the range of 10,000 to 30,000 psi.

Block 100 in FIG. 6 describes the fifth step in the treatment method of cooling the runner substrate 74 with the coating 80 thereon encased by the container 86 or cover 94. In order to alleviate problems associated with the differential thermal expansion coefficients of the substrate and coating, the thermal cooling should be controlled to approximately 100 degrees C. per hour. In other words, cooling is carried out at a rate of about 100 degrees C. per hour.

Upon completion of the HIP and cooling steps, the container 86 or cover 94 are removed as depicted by the block 102 depicting the sixth step of the treatment method in FIG. 6. The runner substrate 74 and coating 80 are then cleaned and finish machined.

Test Results

In experimentation, three coupons were used to simulate the sealing runner with the coating thereon. Each coupon was about 3 inches in diameter and ½ inch thick, and machined to provide a ½ inch wide, 0.007 inch groove on one face. Chromium carbide was deposited onto the groove, to form the reactor coolant pump seal surface, by a detonation gun and the coating machined per established procedures.

Coupon No. 1 was used as a control sample; Coupon Nos. 2 and 3 were used to demonstrate the concepts of the present invention. Coupon No. 2 was incorporated into a stainless steel can, using ceramic powder to isolate the workpiece from the can material. Then the can was outgassed (evacuated) at 200 degrees C. for four hours in a vacuum of about $5.8\times10^{-6}$ microns and sealed. The "canned" Coupon No. 2 along with the "un-canned" Coupon No. 3 were then HIPed at 1300 degrees C. and 25,000 psi for two hours. The HIP furnace was cooled at a rate of about 100 degrees C. per hour to room temperature prior to removing the two samples.

Coupon No. 2 was decontainerized and it was observed from measurement of the coating thickness (before and after HIPing) that the seal was densified. On the other hand, in Coupon No. 3 (which was not canned) the coating separated and frayed thus demonstrating the need for "canning" in order to obtain an integral product.

Coupon No. 1 (the control sample) and Coupon No. 2 were then subjected to an accelerated laboratory corrosion test in a sulphur and chlorine solution. This solution overexagerates actual conditions but is necessary to accelerate blistering observed on RCP seal runner and insert surfaces. The coupons were intermittently weighed at 500 hour intervals. Although Coupon No. 1 showed weight loss starting at 500 hours, no weight change was observed in the HIPed Coupon No. 2 for greater than 3000 hours, thus very convincingly demonstrating that the corrosion resistance was improved by a factor of at least six.

Figure 9:
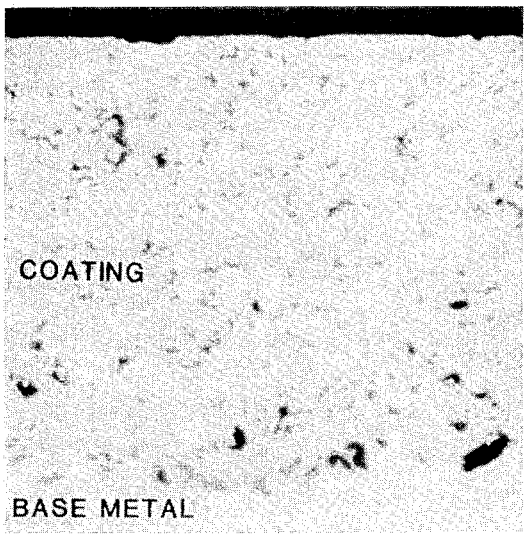
FIG. 9 is a photomicrograph of a cross-section through a non-HIPed coating and base or substrate at 500X.
Figure 10:
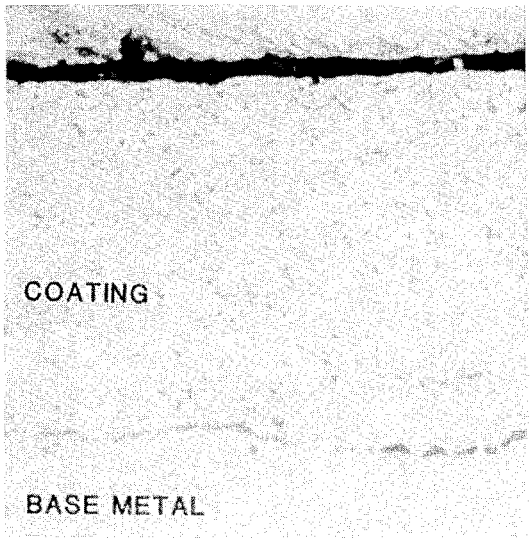
FIG. 10 is a photomicrograph of a cross-section through a HIPed coating and base at 500X.

FIGS. 9 and 10 are photomicrographs of cross sections through non-HIPed and HIPed coatings at 500X magnification in the unetched condition. The difference in thickness of 0.0005 inch is believed to be due to densification. The porous nature of the non-HIPed coating can clearly be seen in FIG. 9, whereas no pores can be observed in the HIPed coating in FIG. 10. What looks like pores in FIG. 10 are actually are differences in the etching of the coating material.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

We claim:

1. A method of treating a coating on a sealing surface of a sealing assembly component, said treating method comprising the steps of:

(a) applying a material onto a groove formed on the sealing surface of the sealing assembly component to form a coating thereon;

(b) encasing at least the coating on the sealing surface by applying a metallic cover thereover, said encasing being carried out by welding the cover to the surface of the sealing assembly component so as to seal the cover thereon from the external atmosphere;

(c) evacuating the atmosphere between the cover and coating on the sealing surface; and (d) hot isostatic pressing the sealing assembly component and the coating thereon encased by the cover in order to density the coating to substantially its full theoretical density and metallurgically bond the coating to the surface of the sealing assembly component at the groove thereon.

2. The treating method as recited in claim 1, wherein said hot isostatic pressing is carried out at a temperature within the range of 1000 to 1300 degrees C and at a pressure within the range of 10,000 to 30,000 psi.

3. The treating method as recited in claim 1, further comprising:

(e) cooling the sealing assembly component and the coating thereon encased by the cover; and (f) after cooling thereof, removing the cove from the coating.

4. The treating method as recited in claim 3, wherein said cooling is carried out at a rate of about 100 degrees C. per hour.

5. A method of treating an annular chromium carbide coating on an annular sealing surface of a stainless steel sealing assembly component for use in a nuclear reactor coolant pump, said treating method comprising the steps of:

(a) applying chromium carbide on the annular sealing surface of the sealing assembly component to form an annular chromium carbide coating thereon;

(b) encasing at least the chromium carbide coating on the stainless steel sealing surface by applying a metallic cover thereover, said encasing being carried out by welding the cover to the surface of the sealing assembly component so as to seal the coating thereon from the external atmosphere;

(c) evacuating the atmosphere between the cover and the coating on the sealing surface; and (d) hot isostatic pressing the stainless steel sealing assembly component and the chromium carbide coating thereon encased by the cover in order to densify the coating to substantially its full theoretical density and metallurgically bond the coating to the surface of the sealing assembly component.

6. The treating method as recited in claim 5, wherein said hot isostatic pressing is carried out at a temperature within the range of 1000 to 1300 degrees C. and at a pressure within the range of 10,000 to 30,000 psi.

7. The treating method as recited in claim 5, further comprising:

(e) cooling the sealing assembly component and the coating thereon encased by the cover; and (f) after cooling thereof, removing the cover from the coating.

8. The treating method as recited in claim 7, wherein said cooling is carried out at a rate of about 100 degrees C. per hour.

9. A method of treating a coating on a sealing surface of a sealing assembly component, said treating method comprising the steps of:

(a) applying a material onto a groove formed on the sealing surface of the sealing assembly component to form a coating thereon;

(b) encasing the coating on the sealing surface by enclosing the sealing assembly component and coating thereon in a sealed metallic container;

(c) evacuating the atmosphere between the cover and coating on the sealing surface; and (d) hot isostatic pressing the sealing assembly component and the coating thereon encased by the cover in order to densify the coating to substantially its full theoretical density and metallurgically bond the coating to the surface of the sealing assembly component at the groove thereon;

(e) said encasing also being carried out by placing a barrier between the interior enclosing the sealing assembly component and coating thereon in a sealed metallic container, placing a barrier between the interior of the container and the surface of component with the coating applied thereon, and by placing a molybdenum sheet between the barrier and the surface of the component with the coating applied thereon.

10. A method of treating an annular chromium carbide coating on an annular sealing surface of a stainless steel sealing assembly component for use in a nuclear reactor coolant pump, said treating method comprising the steps of:

(a) applying chromium carbide on the annular sealing surface of the sealing assembly component to form an annular chromium carbide coating thereon;

(b) encasing the chromium carbide coating on the stainless steel sealing surface by enclosing the sealing assembly component and coating thereon in a sealed metallic container;

(c) evacuating the atmosphered between the cover and the coating on the sealing surface; and (d) hot isostatic pressing the stainless steel sealing assembly component and the chromium carbide coating thereon encased by the cover in order to density the coating to substantially its full theoretical density and metallurgically bond the coating to the surface of the sealing assembly component;

(e) said encasing also being carried out by placing a barrier between the interior of the container and the surface of component with the coating applied thereon, and by placing a molybdenum sheet between the barrier and the surface of the component with the coating applied thereon.

* * * * *